US012043956B2

(12) United States Patent
Nakayama et al.

(10) Patent No.: US 12,043,956 B2
(45) Date of Patent: Jul. 23, 2024

(54) NAPPED ARTIFICIAL LEATHER

(71) Applicant: KURARAY CO., LTD., Kurashiki (JP)

(72) Inventors: Kimio Nakayama, Okayama (JP); Hiroyuki Hishida, Okayama (JP)

(73) Assignee: KURARAY CO., LTD., Kurashiki (JP)

( * ) Notice: Subject to any disclaimer, the term of this patent is extended or adjusted under 35 U.S.C. 154(b) by 0 days.

(21) Appl. No.: 16/964,349

(22) PCT Filed: Feb. 4, 2019

(86) PCT No.: PCT/JP2019/003784
§ 371 (c)(1),
(2) Date: Jul. 23, 2020

(87) PCT Pub. No.: WO2019/159728
PCT Pub. Date: Aug. 22, 2019

(65) Prior Publication Data

US 2021/0032807 A1 Feb. 4, 2021

(30) Foreign Application Priority Data

Feb. 19, 2018 (JP) ..... 2018-026944

(51) Int. Cl.
*D06N 3/00* (2006.01)
*D06N 3/14* (2006.01)

(52) U.S. Cl.
CPC ..... *D06N 3/0011* (2013.01); *D06N 3/0036* (2013.01); *D06N 3/0075* (2013.01); *D06N 3/14* (2013.01); *D06N 2203/068* (2013.01); *D06N 2209/0823* (2013.01); *D06N 2209/1635* (2013.01); *D06N 2211/28* (2013.01)

(58) Field of Classification Search
CPC .. D06N 3/0011; D06N 3/0036; D06N 3/0075; D06N 3/14; D06N 2209/0823; D01F 1/02–04
See application file for complete search history.

(56) References Cited

U.S. PATENT DOCUMENTS 4,519,804 A 5/1985 Kato et al.
2004/0063366 A1* 4/2004 Nakayama ..... D06N 3/14 442/104
2005/0118394 A1* 6/2005 Tanaka ..... D06N 3/0004 442/268
2009/0047476 A1* 2/2009 Meguro ..... D06N 3/14 428/151
2009/0274862 A1* 11/2009 Nakayama ..... D06N 3/144 428/91
2011/0070422 A1* 3/2011 Ammirati ..... D06N 3/147 428/297.4
2020/0071879 A1 3/2020 Meguro

FOREIGN PATENT DOCUMENTS

| | | | |
|---|---|---|---|
| EP | 3 272 936 | A1 | 1/2018 |
| JP | 59-9279 | A | 1/1984 |
| JP | 6-192968 | A | 7/1994 |
| JP | 2004-315987 | A | 11/2004 |
| JP | 2006-152461 | A | 6/2006 |
| JP | 4233965 | B2 | 3/2009 |
| JP | 2010-242240 | A | 10/2010 |
| JP | 2011-523985 | A | 8/2011 |
| JP | 2017-106127 | A | 6/2017 |
| WO | WO 2018/230417 | A1 | 12/2018 |

OTHER PUBLICATIONS

International Search Report issued on Apr. 23, 2019 in PCT/JP2019/003784 filed on Feb. 4, 2019, 2 pages.
Extended European Search Report issued Dec. 9, 2021 in European Patent Application No. 19754320.0, 8 pages.

* cited by examiner

*Primary Examiner* — Larissa Rowe Emrich
(74) *Attorney, Agent, or Firm* — Oblon, McClelland, Maier & Neustadt, L.L.P.

(57) ABSTRACT

Disclosed is a napped artificial leather including: a non-woven fabric containing polyester fibers having an average fineness of 0.07 to 0.9 dtex; and an elastic polymer applied in the non-woven fabric, wherein the polyester fibers contain 0.5 to 10 mass % of a dark color pigment, the napped artificial leather has a napped surface on which the polyester fibers on at least one side thereof are napped, and the napped surface has a lightness L* value based on the L*a*b* color system, of ≤20, and the napped artificial leather has a peel strength of 3 kg/cm or more, and a grade of color difference, determined using a Grey scale for assessing staining in an evaluation of color migration to a multifiber adjacent fabric (co-woven fabric No. 1; the same applied to the following) during pressurization under heating in a wet state under a load of 4 kPa at 200° C. for 60 seconds, of 4 or more.

11 Claims, No Drawings

NAPPED ARTIFICIAL LEATHER

TECHNICAL FIELD

The present invention relates to a napped artificial leather that is colored in a dark color.

BACKGROUND ART

Napped artificial leathers that provide a dense fluff, such as a suede-like artificial leather and a nubuck-like artificial leather, are known. A napped artificial leather is used as a surface material for clothing, shoes, articles of furniture, car seats, general merchandise, and the like, and a surface material for the casing of a mobile phone, a mobile device, a home electrical appliance, and the like. Such a napped artificial leather is usually colored before use.

The napped artificial leather is obtained by buffing the fibers on the surface layer of an artificial leather base material obtained by containing an elastic polymer such as polyurethane inside a non-woven fabric of ultrafine fibers. As the non-woven fabric of ultrafine fibers used for the napped artificial leather, a non-woven fabric of polyester ultrafine fibers is preferably used because of its excellent mechanical properties, durability, and texture.

Disperse dyes are widely used to color the napped artificial leather including a non-woven fabric of polyester ultrafine fibers. However, when a non-woven fabric of polyester ultrafine fibers is dyed with a disperse dye, a large amount of the disperse dye needs to be deposited in order to color the non-woven fabric in a dark color. In this case, there is a problem in that the light resistance and the color migration resistance of the napped artificial leather are likely to be reduced.

An attempt also has been made to dye a leather-like sheet with a cationic dye having excellent color fastness. For example, PTL 1 listed below discloses a cationic dye-dyeable, leather-like sheet including a cationic dye-dyeable polyurethane obtained using, as a monomer, a sulfonic acid group-containing diol obtained by substantially substituting an acid component of sulfoisophthalic acid with a specific diol, and a fiber structure.

In addition, cationic dyeable polyester fibers are also known. For example, PTL 2 listed below discloses a fabric dyed with a cationic dye, wherein the fabric includes copolymerized polyester fibers containing, as a copolymer component, a metal salt (A) of sulfoisophthalic acid and a quaternary phosphonium salt or quaternary ammonium salt (B) of sulfoisophthalic acid in an acid component such that $3.0 \leq A+B \leq 5.0$ (mol %), $0.2 \leq B/(A+B) \leq 0.7$.

For the purpose of coloring a napped artificial leather, PTL 3 listed below discloses a napped artificial leather obtained by coloring fibers and an elastic polymer with a pigment, wherein 0.1 to 8 mass % of a pigment is contained in fibers such as polyester fibers with 0.2 dtex or less, 1 to 20 mass % of a pigment is contained in an elastic polymer, and the mass ratio of the fibers and the elastic polymer is 85/15 to 40/60.

CITATION LIST

Patent Literatures

[PTL 1] Japanese Laid-Open Patent Publication No. 6-192968

[PTL 2] Japanese Laid-Open Patent Publication No. 2010-242240

[PTL 3] Japanese Patent 4233965

SUMMARY OF INVENTION

Technical Problem

When the leather-like sheet disclosed in PTL 1, which includes a cationic dye-dyeable polyurethane and a fiber structure, is dyed with a cationic dye, the fiber structure is difficult to be dyed if it is not cationic-dye dyeable. As a result, there will be a difference between the color of the polyurethane and the color of the fiber structure, resulting in a low-quality leather-like sheet with a distinct two-color impression. When a cationic dye-dyeable polyurethane is dyed in a dark color with a cationic dye, color migration to another article is likely to occur, and the light resistance is also reduced.

The cationic dye-dyeable polyester fibers disclosed in PTL 2 contain a copolymer unit serving as a dye site for depositing a cationic dye. The cationic dye-dyeable polyester fibers have the problem of a low fiber strength. As a result, a napped artificial leather containing cationic dye-dyeable polyester fibers is problematic in that it has a low peel strength, and that the ultrafine fibers are likely to come off when the surface is rubbed.

When the napped artificial leather disclosed in PTL 3, which includes an elastic polymer in which a pigment is contained, is colored in a dark color, the color of the pigment contained in the elastic polymer is likely to migrate to another article, and the light resistance is also reduced. In particular, when the content ratio of the elastic polymer is high, or when the concentration of the pigment contained in the elastic polymer is high, the above-described problems tend to occur prominently. Furthermore, when the content ratio of the elastic polymer is high, the mass ratio of the fibers is relatively low, so that the peel strength may be reduced, a peculiar rubber-like resiliency may appear, the napped feel of the fibers may be poor, or there may be a difference between the color of the fibers and the color of the elastic polymer, resulting in a distinct two-color impression. Accordingly, a low-quality napped artificial leather tends to be obtained.

It is an object of the present invention to solve the above-described problems and provide a high-quality napped artificial leather that is colored in a dark color, wherein the napped artificial leather is excellent in dark color development, light resistance, and color migration resistance, and maintains a high peel strength.

Solution to Problem

An aspect of the present invention is directed to a napped artificial leather including: a non-woven fabric containing polyester fibers having an average fineness of 0.07 to 0.9 dtex; and an elastic polymer applied in the non-woven fabric, wherein the polyester fibers contain 0.5 to 10 mass % of a dark color pigment, the napped artificial leather has a napped surface on which the polyester fibers on at least one side thereof are napped, and the napped surface has a lightness L* value based on the L*a*b* color system, of ≤20, and the napped artificial leather has a peel strength of 3 kg/cm or more, and a grade of color difference, determined using a Grey scale for assessing staining in an evaluation of color migration to a multifiber adjacent fabric (co-woven fabric No. 1; the same applied to the following) during pressurization under heating in a wet state under a load of 4 kPa at 200° C. for 60 seconds, of 4 or more.

Another aspect of the present invention is directed to a napped artificial leather including: a non-woven fabric that is an entangled body of a fiber bundle of isophthalic acid-modified polyester fibers containing 0.5 to 10 mass % of carbon black and having an average fineness of 0.07 to 0.9 dtex; and an elastic polymer applied in the non-woven fabric, wherein the napped artificial leather has, on at least one side thereof, a napped surface on which the isophthalic acid-modified polyester fibers are napped, and the napped surface has a lightness L* value based on the L*a*b* color system, of 20, the napped artificial leather is not dyed, or dyed with a metal complexed dye or a sulfur dye, the elastic polymer contains a first elastic polymer that is present outside the fiber bundle, and a second elastic polymer that is present inside the fiber bundle, a content ratio of the elastic polymer is 0.1 to 15 mass %, and a content ratio of the second elastic polymer is 0.1 to 3 mass %, and the napped artificial leather has a peel strength of 3 kg/cm or more.

According to the present invention, it is possible to obtain a high-quality napped artificial leather that develops a strong dark color with a lightness L* value of ≤20, is excellent in light resistance and color migration resistance, and maintains a high peel strength of 3 kg/cm or more.

Note that, in the case of coloring polyester fibers with a pigment, if it the fineness is too low, it is difficult to develop a dark color unless the pigment is blended in a large amount. In the case of blending a large amount of a pigment when the fineness is low, the mechanical properties of the polyester fibers are reduced, resulting in a reduced peel strength. When a large amount of an elastic polymer is contained in a non-woven fabric, the difference between the color of the polyester fibers and the color of the elastic polymer results in a two-color impression. Also, the mass ratio of the polyester fibers is relatively low, so that the peel strength tends to be reduced. When the fineness of the polyester fibers is high, the surface feels rough.

With such a napped artificial leather, it is possible to obtain a napped artificial leather that is excellent in dark color development, has light resistance, color migration resistance, and a high peel strength, and is of high-quality. In particular, when the grade of color difference, determined in an evaluation of color migration to a multifiber adjacent fabric during pressurization under heating in a wet state under a load of 4 kPa at 200° C. for 60 seconds is 4 or more, the color migration can be sufficiently suppressed in the case where the napped artificial leather is bonded to another article under heat or pressure, or where the napped artificial leather comes into contact with an article with a pale color. In particular, the color migration can also be suppressed, for example, in the case where the napped artificial leather is brought into contact with another article, and then bonded thereto by being heat-treated at 150 to 200° C., or where the napped artificial leather is brought into contact with a vinyl chloride film that tends to be bonded to an elastic polymer.

When the content ratio of the elastic polymer contained in the napped artificial leather is 0.1 to 15 mass %, the mass ratio of the fibers will not be relatively too low, so that a high peel strength can be maintained, and a two-color impression due to a difference between the color of the fibers and the color of the elastic polymer is less likely to appear. As a result, it is possible to obtain a napped artificial leather that is well-balanced in the high-quality appearance, the tactile impression, the color migration resistance, and the high peel strength.

It is preferable that the non-woven fabric is an entangled body of a fiber bundle of the polyester fibers, and the elastic polymer contains a first elastic polymer that is present outside the fiber bundle, and a second elastic polymer that is present inside the fiber bundle, because it is possible to maintain a high peel strength even when the content ratio of the elastic polymer is low. In this case, it is preferable that the content ratio of the second elastic polymer is 0.1 to 3 mass %.

It is preferable that the elastic polymer contains no dark color pigment, or contains 0 to 1 mass % of a dark color pigment, in terms of the particularly excellent color migration resistance.

It is preferable that the napped artificial leather is not dyed, or is dyed with a metal complexed dye or a sulfur dye), because the color migration resistance will not be reduced.

It is preferable that the dark color pigment contains carbon black, in terms of the particularly excellent light resistance and color migration resistance.

It is preferable that the polyester fibers are isophthalic acid-modified polyester fibers, because a high peel strength can be easily maintained.

It is preferable that the napped artificial leather has a grade of color difference, determined using a Grey scale for assessing staining in an evaluation of color migration to a multifiber adjacent fabric during pressurization under heating in a dry state under a load of 4 kPa at 200° C. for 60 seconds, of 4 or more, because the color migration can be further suppressed in the case where the napped artificial leather is used in an application in which it is brought into contact with another article, and bonded thereto by being heat-treated at 150 to 200° C.

It is preferable that the napped artificial leather has a grade of color difference, determined using a Grey scale for assessing change in colour in a test of lightfastness to ultraviolet carbon arc lamp light in accordance with JIS L 0842, of 4 or more, because an excellent light resistance can also be achieved.

It is preferable that the napped artificial leather has a color difference of a vinyl chloride film before and after color migration, determined in an evaluation of color migration to the vinyl chloride film under a load of 750 g/cm$^2$ at 50° C. for 16 hours, of $\Delta E^* \leq 2.0$, because a particularly excellent color migration resistance can be achieved in the case where the napped artificial leather is used in an application in which it is brought into contact with another article, and bonded thereto by being heat-treated at 150 to 200° C.

Advantageous Effects of Invention

According to the present invention, it is possible to provide a napped artificial leather that is colored in a strong dark color, wherein the napped artificial leather has high light resistance, color migration resistance, peel strength, and is of high appearance.

DESCRIPTION OF EMBODIMENT

First, an embodiment of a napped artificial leather according to the present invention will be described in detail, in conjunction with an exemplary production method thereof.

In a production method of a napped artificial leather according to the present embodiment, first, an artificial leather base material that includes a non-woven fabric that is a fiber-entangled body that contains polyester fibers containing 0.5 to 10 mass % of a dark color pigment and having an average fineness of 0.07 to 0.9 dtex, and an elastic polymer applied in the non-woven fabric is prepared. Such an artificial leather base material can be produced, for example, in the following manner.

First, an entangled body of ultrafine fiber-generating fibers for forming a non-woven fabric of polyester fibers containing 0.5 to 10 mass % of a dark color pigment and having an average fineness of 0.07 to 0.9 dtex is produced.

In the production of the entangled body of the ultrafine fiber-generating fibers, first, a fiber web of the ultrafine fiber-generating fibers is produced. Examples of the production method of the fiber web include a method involving melt-spinning ultrafine fiber-generating fibers and directly collecting the resultant fibers as filaments without intentionally cutting them, and a method involving cutting the resultant fibers into staples and subjecting them to a known entangling treatment. The filament is a continuous fiber or filament that has not been cut into a predetermined length, and the length thereof is, for example, preferably 100 mm or more, more preferably 200 mm or more, from the viewpoint of sufficiently increasing the fiber density. The upper limit of the length of the filaments is not particularly limited, and may be several meters, several hundred meters, several kilometers, or longer, and continuously spun. Among these, it is particularly preferable to produce a filament web because the fibers are less likely to fall out, so that the amount of the elastic polymer to be contained to prevent the falling out can be easily reduced. In the present embodiment, the production of a filament web will be described in detail as a representative example.

The ultrafine fiber-generating fibers refer to fibers that form ultrafine fibers with a small fineness as a result of performing a chemical or physical post-treatment on the spun fibers. Specific examples thereof include island-in-the-sea composite fibers in which an island component resin serving as a domain different from a sea component resin serving as a matrix is dispersed in the sea component on the fiber cross section, and the sea component resin is removed to form ultrafine fibers in the form of a fiber bundle composed mainly of the island component resin. The examples also include strip/division-type composite fibers in which a plurality of different resin components are alternately disposed around the periphery of a fiber to form a petaline shape or a superposed shape, and the fiber is divided as a result of the resin components being stripped from the fiber by a physical treatment, thereby forming ultrafine fibers in the form of a bundle. With the island-in-the-sea composite fibers, ultrafine fibers in the form of a fiber bundle are formed. In the present embodiment, a case where island-in-the-sea composite fibers are produced as the ultrafine fiber-generating fibers will be described as a representative example.

A filament web of the island-in-the-sea composite fibers is formed by melt-spinning the island-in-the-sea composite fibers and directly collecting the resultant fibers as filaments on a net without cutting them.

Specific examples of the polyester serving as the island component resin for generating polyester fibers in the island-in-the-sea composite fibers include aromatic polyesters such as polyethylene terephthalate (PET), isophthalic acid-modified PET, sulfoisophthalic acid-modified PET, polybutylene terephthalate, and polyhexamethylene terephthalate; and aliphatic polyesters such as polylactic acid, polyethylene succinate, polybutylene succinate, polybutylene succinate adipate, and a polyhydroxybutyrate-polyhydroxyvalerate resin. These may be used alone or in a combination of two or more.

Among polyesters, isophthalic acid-modified PET is preferable because it offers an excellent balance between the melt spinnability and the fiber strength, and the amount of the elastic polymer to be contained to prevent the falling out of the fibers can be easily reduced. Note that the ratio of the modified monomer in the modified PET is preferably 0.1 to 30 mol %, more preferably 0.5 to 15 mol %, particularly preferably 1 to 10 mol %. The island component resin may contain, in combination with the polyester, polyamides such as polyamide 6, polyamide 66, polyamide 10, polyamide 11, polyamide 12, and polyamide 6-12; polyolefins such as polypropylene, polyethylene, polybutene, polymethylpentene, and a chlorine-based polyolefin, as long as the effects of the present invention are not impaired.

In order to obtain polyester fibers colored in a dark color, the polyester is colored with a dark color pigment. The dark color pigment means a pigment capable of reducing the lightness L* value of a natural color polyester to which no pigment is added. Specific examples of such a dark color pigment include inorganic pigments, including, black pigments such as carbon black, blue pigments such as ultramarine blue and Prussian blue (ferric potassium ferrocyanide), red pigments such as red lead and iron oxide red, and yellow pigments such as chrome yellow, zinc yellow (zinc yellow type 1, zinc yellow type 2), and organic pigments, including, condensed polycyclic organic pigments of various colors such as a phthalocyanine-based pigment, an anthraquinone-based pigment, a quinacridone-based pigment, a dioxazine-based pigment, an isoindolinone-based pigment, an isoindoline-based pigment, an indigo-based pigment, a quinophthalone-based pigment, a diketopyrrolopyrrole-based pigment, a perylene-based pigment, and a perinone-based pigment, and insoluble azo-based pigments such as a benzimidazolone-based pigment, a condensed azo-based pigment and an azomethine azo-based pigment. These may be used alone or in a combination of two or more. Among these, carbon black is preferable because it allows the fibers to be easily colored into a dark color with a lightness L* value of ≤20, and has excellent light resistance.

The content ratio of the dark color pigment in a polyester composition that forms the polyester fibers and that contains the dark color pigment is 0.5 to 10 mass %, and can be selected as appropriate according to the average fineness and the target color of the polyester fibers, and the type of the pigment. For example, when the polyester fibers have an average fineness of 0.07 to 0.5 dtex, the content ratio is preferably 1 to 10 mass % in order to color the fibers to have a lightness L* value of ≤20, and is preferably 4 to 10 mass % in order to color the fibers to have an L* value of ≤18. When the polyester fibers have an average fineness of 0.3 to 0.9 dtex, the content ratio is preferably 1 to 8 mass % in order to color the fibers in a color with an L* value of ≤20, and is preferably 4 to 8 mass % in order to color the fibers in a color with an L* value of ≤18. When the content ratio of the dark color pigment in the polyester composition exceeds 10 mass %, the mechanical properties and the melt spinnability of the resulting polyester fibers are reduced.

For the purpose of, for example, adjusting the spinning operability or the hue of the resulting artificial leather suede, a white pigment such as zinc white, white lead, lithopone, titanium dioxide, precipitated barium sulfate or barytes powder, and silica such as colloidal silica, for example, may be blended, together with the dark color pigment, in the polyester composition that forms the polyester fibers, as long as the effects of the present invention are not impaired. In addition, a weathering agent, an antifungal agent, a hydrolysis inhibitor, a lubricant, fine particles, a frictional resistance adjustor, and the like may be blended, as long as the effects of the present invention are not impaired.

As the sea component resin in the island-in-the-sea composite fibers of the present embodiment, a thermoplastic resin that differs from the island component resin in solubility in a solvent or in decomposability in a decomposition agent is selected. Specific examples of the sea component resin include water-soluble polyvinyl alcohol-based resins, polyethylene, polypropylene, polystyrene, ethylene-propylene resins, ethylene-vinyl acetate resins, styrene-ethylene resins, and styrene-acrylic resins.

The island-in-the-sea composite fibers are produced by melt spinning in which molten island-in-the-sea composite fibers discharged from the spinneret of a melt spinning machine are cooled by a cooling apparatus, and further drawn and attenuated by a suction apparatus such as an air jet nozzle so as to have a desired fineness. The drawing and attenuation is performed using a high-velocity air stream that provides a high spinning rate corresponding to a take-up speed of preferably 1000 to 6000 m/min, more preferably 2000 to 5000 m/min. Then, the drawn and attenuated filaments are piled on a collection surface of a movable net or the like, thereby obtaining a filament web of the island-in-the-sea composite fibers.

The average fineness of the island-in-the-sea composite fibers is not particularly limited, but is preferably 0.5 to 10 dtex, more preferably 0.7 to 5 dtex, in terms of the excellent foLmability of the non-woven fabric. The average area ratio between the sea component resin and the island component resin on the cross section of the island-in-the-sea composite fibers is preferably 5/95 to 70/30, more preferably 10/90 to 50/50, because the island-in-the-sea structure can be easily formed. The number of domains of the island component resin on the cross section of the island-in-the-sea composite fibers is not particularly limited, but is preferably about 5 to 1000, more preferably about 10 to 300, from the viewpoint of the industrial productivity.

Note that, if necessary, the shape of the filament web may be stabilized by pressure-bonding a part of the filament web by pressing. The basis weight of the filament web thus obtained is not particularly limited, but is preferably in the range of 10 to 1000 g/m$^2$, for example.

Next, the obtained filament web is subjected to an entangling treatment, thereby producing an entangled web of the island-in-the-sea composite fibers. Specific examples of the entangling treatment for the filament web include a treatment in which a plurality of layers of the filament web are superposed in the thickness direction using a cross lapper or the like, and subsequently needle-punched simultaneously or alternately from both sides thereof such that at least one barb penetrates the web. In addition, an oil solution, an antistatic agent or the like may be added to the filament web in any stage from the spinning step to the entangling treatment of the island-in-the-sea composite fibers.

If necessary, the entangled web of the island-in-the-sea composite fibers may be subjected to a heat shrinking treatment in order to densify the entangled state of the filaments. Specific examples of the heat shrinking treatment include a method involving bringing the entangled web of the island-in-the-sea composite fibers into contact with water vapor, and a method involving applying water to the entangled web of the island-in-the-sea composite fibers, and subsequently heating the water using hot air or electromagnetic waves such as infrared rays. The change in the basis weight of the entangled web of the island-in-the-sea composite fibers during the heat shrinking treatment is preferably 1.1 times (mass ratio) or more, more preferably 1.3 times or more and 2 times or less, more preferably 1.6 times or less, as compared with the basis weight before the shrinking treatment. In addition to densifying the entangled web of the island-in-the-sea composite fibers, hot pressing may be performed for the purpose of fixing the shape of the entangled web of the island-in-the-sea composite fibers, and smoothing the surface thereof. The basis weight of the entangled web of the island-in-the-sea composite fibers thus obtained is preferably in the range of 100 to 2000 g/m$^2$.

By removing the sea component resin from the entangled web of the island-in-the-sea composite fibers, it is possible to obtain a non-woven fabric of polyester fibers containing 0.5 to 10 mass % of a dark color pigment and having an average fineness of 0.07 to 0.9 dtex. As the method for removing the sea component resin from the island-in-the-sea composite fibers, a conventionally known ultrafine fiber formation method such as a method involving treating the entangled web with a solvent or decomposition agent capable of selectively removing only the sea component resin can be used without any particular limitation. Specifically, in the case of using, for example, a water-soluble PVA as the sea component resin, it is possible to use hot water as the solvent. In the case of using a modified polyester that can be easily decomposed by alkali as the sea component resin, it is possible to use an alkaline decomposition agent such as an aqueous sodium hydroxide solution.

The average fineness of the ultrafine fibers thus formed is 0.07 to 0.9 dtex, preferably 0.2 to 0.5 dtex. This makes it possible to obtain a napped artificial leather that can easily develop a dark color with a small amount of a dark color pigment, maintains a high peel strength, and also has excellent quality.

In the production of a napped artificial leather, an elastic polymer such as polyurethane is impregnated into the internal voids of an entangled web of island-in-the-sea composite fibers or a non-woven fabric of ultrafine fibers before or after, or both before and after generating ultrafine fibers from ultrafine fiber-generating fibers such as island-in-the-sea composite fibers in order to prevent the falling out of, or increase the peel strength of the fibers of the napped artificial leather, or to impart shape stability and fullness to the napped artificial leather.

As the elastic polymer, polyurethane, an acrylic elastic body and the like that have been conventionally used for production of an artificial leather can be used without any particular limitation. Among these, polyurethane is particularly preferable. Specific examples of the polyurethane include polyether-based polyurethanes, polyester-based polyurethanes, polyether ester-based polyurethanes, polycarbonate-based polyurethanes, polyether carbonate-based polyurethanes, and polyester carbonate-based polyurethanes. These may be used alone or in a combination of two or more. Among these, polycarbonate-based polyurethanes are particularly preferable.

It is preferable that the elastic polymer has a 100% modulus of 1 to 8 MPa, because a napped artificial leather that is excellent in suppleness and fullness can be obtained. When the 100% modulus of the elastic polymer is too low, the elastic polymer tends to be fixed to the ultrafine fibers when removing the sea component resin to generate ultrafine fibers, thus impeding napping of the ultrafine fibers. When the 100% modulus is too high, the napped fibers tend to have rough feel.

The elastic polymer may further contain a colorant such as a pigment (e.g., carbon black) or a dye, a coagulation regulator, an antioxidant, an ultraviolet absorber, a fluorescent agent, an antifungal agent, a penetrant, an antifoaming agent, a lubricant, a water-repellent agent, an oil-repellent agent, a thickener, a filler, a curing accelerator, a foaming agent, a water-soluble polymer compound such as polyvinyl alcohol or carboxymethyl cellulose, inorganic fine particles, and a conductive agent, so long as the effects of the present invention are not impaired. Note that when the elastic polymer contains a pigment, the content ratio is preferably 0 to 20 mass %, more preferably 0 to 10 mass %, particularly preferably 0 to 1 mass %. When the content ratio of the pigment in the elastic polymer is too high, the peel strength tends to be reduced, and the color migration resistance also tends to be reduced.

Examples of the method for applying the elastic polymer in the internal voids of the entangled web or the non-woven fabric of ultrafine fibers include methods involving impregnating the entangled web or the non-woven fabric of ultrafine fibers with an emulsion, aqueous solution, or solution of the elastic polymer, for example, by dip-nipping, or using a knife coater, a bar coater, or a roll coater, and solidifying the elastic polymer. Among these, it is preferable to use a method in which an emulsion of the elastic polymer is applied in the entangled web or the non-woven fabric of ultrafine fibers by dip-nipping, and thereafter solidified by drying or wet solidification.

When an emulsion of the elastic polymer is applied by dip-nipping and thereafter solidified by drying, the emulsion may migrate to the surface layer, so that a uniform filled state may not be achieved. In such a case, the migration can be suppressed by, for example, adjusting the particle size of the emulsion; adjusting the type and the amount of the ionic groups of the elastic polymer, or reducing the water dispersion stability using an ammonium salt that undergoes a pH change at a temperature of about 40 to 100° C.; or reducing the water dispersion stability at about 40 to 100° C. by using, in combination, a monovalent or divalent alkali metal salt or alkaline-earth metal salt, a nonionic emulsifier, an associative water-soluble thickener, an associative heat-sensitive gelling agent such as a water-soluble silicone-based compound, or a water-soluble polyurethane-based compound.

Note that when island-in-the-sea composite fibers are subjected to an ultrafine fiber-generating treatment, the sea component resin is removed, thereby forming ultrafine fibers in the form of a fiber bundle. Then, voids are formed inside the fiber bundle of ultrafine fibers. When the non-woven fabric of ultrafine fibers that has been subjected to an ultrafine fiber-generating treatment is impregnated with an emulsion of an elastic polymer, the emulsion of the elastic polymer is likely to be impregnate between the ultrafine fibers by capillary action, and the ultrafine fibers in the form of a fiber bundle are firmly restrained, thus making the ultrafine fibers less likely to fall out, and also improving the peel strength. Accordingly, in the production of a napped artificial leather according to the present embodiment, it is particularly preferable to perform a process in which, after a first elastic polymer has been applied to the entangled web of island-in-the-sea composite fibers, the island-in-the-sea composite fibers are subjected to an ultrafine fiber-generating treatment to form a first intermediate sheet including a non-woven fabric of ultrafine fibers in the form of a fiber bundle, and a second elastic polymer is further applied in the first intermediate sheet, thereby also applying the elastic polymer inside the fiber bundle of the ultrafine fibers.

The content ratio of the elastic polymer in the napped artificial leather is preferably 0.1 to 15 mass %, more preferably 0.5 to 14 mass %, particularly preferably 2.5 to 12 mass %, because the mass ratio of the polyester fibers will not be relatively too low, so that the peel strength can be kept high, and also because the two-color impression of the elastic polymer and the polyester fibers is less likely to appear due to good napping properties of the napped artificial leather, so that a flexible texture with little resiliency can be easily obtained. The above-described content ratios are preferable also because an excellent color migration resistance can be achieved in the case where the napped artificial leather comes into contact with another article at a high temperature, for example, 150 to 200° C., or where the napped artificial leather is brought into contact with an article, such as a vinyl chloride film, that is likely to be bonded to the elastic polymer. In the napped artificial leather of the present embodiment, it is preferable that the polyester fibers are densely entangled such that the napped artificial leather has a peel strength of 3 kg/cm or more, and the ratio of the elastic polymer applied in order to prevent the falling out of the polyester fibers is not excessively increased, because the two-color impression due to color unevenness between the polyester fibers and the elastic polymer can be reduced, and the color migration can also be reduced.

The content ratio of the second elastic polymer that is present inside the fiber bundle is preferably 0.1 to 3 mass %, because of ease of increase in the peel strength.

In this manner, an artificial leather base material in which an elastic polymer is impregnated into a non-woven fabric of polyester fibers containing 0.5 to 10 mass % of a dark color pigment and having an average fineness of 0.07 to 0.9 dtex is obtained. Then, the artificial leather base material is sliced into a plurality of pieces or ground in a direction perpendicular to the thickness direction as needed, to regulate the thickness. Further, at least one surface of the artificial leather base material is buffed, thereby obtaining a napped artificial leather gray fabric having a napped surface on at least one side thereof. It is preferable that the buffing is performed using sandpaper or emery paper with a grit number of 120 to 600, for example.

Although the polyester fibers contained in the napped artificial leather gray fabric is colored with a dark color pigment, if necessary, it is possible to combine dyeing for color adjustment, or a treatment in which a liquid in which a pigment and a pigment binder are mixed is impregnated and dried, to attach the pigment by using the binder.

For dyeing, it is preferable to use a metal complexed dye, a sulfur dye, a printing dye, a reactive dye, and a cationic dye used for coloring acidic group-containing polyester fibers. In particular, it is preferable to perform dyeing with a metal complexed dye or a sulfur dye, because it is possible to perform dyeing with suppressed color migration without reducing the fiber strength. As the metal complexed dye and the sulfur dye, metal complexed dyes and sulfur dyes that have been conventionally used for dyeing nylon fibers and polyurethane can be used without any particular limitation. The method for dyeing is not particularly limited, and examples thereof include methods in which dyeing is performed using a dyeing machine such as a jet dyeing machine, a beam dyeing machine, or a jigger. An example of the dyeing temperature is about 60 to 140° C. In addition, a dyeing assistant such as an acetic acid and mirabilite may be used during dyeing. Also, the texture may be adjusted by performing a treatment such as a liquid stream treatment without introducing a dye. Note that a disperse dye is not preferable because of its tendency to cause migration. Additionally, in order to prevent reduction of the color migration resistance in particular, it is preferable that the napped artificial leather is not dyed.

The napped artificial leather gray fabric may be further subjected to various finishing treatments as needed. Examples of the finishing treatment include a flexibilizing treatment by crumpling, a reverse seal brushing treatment, an antifouling treatment, a hydrophilization treatment, a lubricant treatment, a softener treatment, an antioxidant treatment, an ultraviolet absorber treatment, a fluorescent agent treatment, a flame retardant treatment, and a darkening agent treatment.

The napped artificial leather includes a non-woven fabric that includes polyester fibers containing 0.5 to 10 mass % of a dark color pigment and having an average fineness of 0.07 to 0.9 dtex, and an elastic polymer applied inside the non-woven fabric. With such a napped artificial leather, it is possible to obtain a napped artificial leather having a high peel strength, specifically, a peel strength of 3 kg/cm or more, even when the content ratio of the elastic polymer is low. With the non-woven fabric that includes polyester fibers containing 0.5 to 10 mass % of a dark color pigment and having an average fineness of 0.07 to 0.9 dtex, it is possible to obtain a napped artificial leather having a grade of color difference, determined in an evaluation of color migration to a multifiber adjacent fabric during heating in a wet state under a load of 4 kPa at 200° C. for 60 seconds, of 4 or more even when the lightness L* value is <20.

The lightness L* value based on the L*a*b* color system of the napped surface of the napped artificial leather is that of a strong dark color, namely, an L* value of ≤20, preferably an L* value of ≤18, more preferably an L* value of ≤17. In the napped artificial leather with a strong dark color, a two-color impression tends to appear due to a difference between the color of the elastic polymer and the color of the polyester fibers. However, it is possible to suppress the two-color impression by reducing the content ratio of the elastic polymer. The lower limit of the L* value is not particularly limited, but is preferably 8, more preferably 10.

The peel strength of the napped artificial leather is 3 kg/cm or more, preferably 3.1 kg/cm or more, more preferably 3.5 kg/cm or more.

The grade of color difference of the napped artificial leather, determined in an evaluation of color migration to a multifiber adjacent fabric during pressurization under heating in a wet state under a load of 4 kPa at 200° C. for 60 seconds is 4 or more, or 4-5 or more. By having such a color migration property during pressurization under heating, the napped artificial leather according to the present embodiment has a property of being less likely to cause color migration to many types of fabrics such as cotton, nylon, acetate, wool, rayon, acrylic, silk, and polyester fabrics even when it is pressurized under heating in a wet condition.

The grade of color difference, determined in an evaluation of color migration to a multifiber adjacent fabric during pressurization under heating in a dry state under a load of 4 kPa at 200° C. for 60 seconds, is 4 or more, preferably 4-5 or more.

With the napped artificial leather according to the present embodiment, the polyester fibers that form the non-woven fabric is colored in a deep dark color with a dark color pigment, whereby it is possible to achieve high lightfastness such that the grade of color difference, determined using a Grey scale for assessing change in colour in a test of lightfastness to ultraviolet carbon arc lamp light in accordance with JIS L 0842, is 4 or more, or 4-5 or more.

It is also possible to achieve high color migration resistance to a vinyl chloride film such that the color difference of a vinyl chloride film before and after color migration, determined in an evaluation of color migration to the vinyl chloride film under a load of 750 g/cm$^2$ at 50° C. for 16 hours, is $\Delta E^*$ 2.0.

EXAMPLES

Hereinafter, the present invention will be described more specifically by way of examples. It should be appreciated that the scope of the present invention is by no means limited by the examples.

Example 1

Water-soluble thermoplastic polyvinyl alcohol (PVA) as a sea component resin, and isophthalic acid-modified polyethylene terephthalate to which 5 mass % of carbon black had been added and that had a degree of modification of 6 mol % as an island component resin were prepared. Then, the sea component resin and the island component resin were supplied to a multicomponent fiber spinning spinneret set at a spinneret temperature of 260° C. and having nozzle holes disposed in parallel so as to form a cross section on which 12 island component resin portions having uniform cross-sectional areas were distributed in the sea component resin, and the molten fibers were discharged from the nozzle holes. At this time, the molten fibers were supplied while adjusting the pressure such that the mass ratio between the sea component resin and the island component resin satisfies Sea component resin/Island component resin=25/75.

Then, the discharged molten fibers were stretched by suction using a suction apparatus so as to provide an average spinning speed of 3700 m/min, and thereby to spin filaments of the island-in-the-sea composite fibers having a fineness of 3.3 dtex. The filaments of the island-in-the-sea composite fibers were continuously piled on a movable net, and lightly pressed with a metal roll at 42° C. in order to suppress the fuzzing on the surface. Then, the filaments of the island-in-the-sea composite fibers were separated from the net, and allowed to pass between a grid-patterned metal roll and a back roll at a surface temperature of 55° C. under a linear load of 200 N/mm. In this manner, a filament web with a basis weight 32 g/m$^2$ was produced.

Next, a superposed web in which 12 layers of the filament web were stacked using a cross lapper apparatus so as to have a total basis weight of 380 g/m$^2$ was produced, and an oil solution for preventing the needle from breaking was sprayed thereto. Then, the superposed web was needle-punched at a density of 3300 punch/cm$^2$ alternately from both sides by using 6-barb needles with a distance of 3.2 mm from the needle tip to the first barb at a punching depth of 8.3 mm, thus producing an entangled web of the island-in-the-sea composite fibers with a basis weight of 500 g/m$^2$. The area shrinkage of the superposed web due to the needle punching was 70%. Then, the entangled web was subjected to a heat-moisture shrinking treatment for 30 seconds under a humidity of 50% RH and 70° C. at a take-up line speed of 10 m/min. The area shrinkage of the entangled web due to the heat-moisture shrinking treatment was 48%.

Then, 15 mass % of a self-emulsified amorphous polycarbonate urethane having a 100% modulus of 3.0 MPa as an emulsion of a first elastic polymer, and an emulsion of a first polyurethane containing 2.5 mass % of ammonium sulfate as a heat-sensitive gelling agent were prepared. Then, the entangled web that had been subjected to heat-moisture shrinking was impregnated with the emulsion of the first polyurethane, and thereafter dried at 150° C., to solidify the first polyurethane.

Then, the entangled web containing the island-in-the-sea composite fibers impregnated with the first polyurethane was repeatedly dip-nipped in hot water at 95° C., to remove PVA serving as the sea component resin, and thereafter the entangled web was dried. In this manner, a first intermediate sheet including a non-woven fabric in which fiber bundles each including 12 filaments of polyester fibers with a fineness of 0.2 dtex were three-dimensionally entangled was formed. The first polyurethane content in the napped artificial leather was 9.5 mass %.

Then, the first intermediate sheet was sliced in half, and one surface thereof was buffed to adjust the thickness to 0.55 mm, thus obtaining a second intermediate sheet. The second intermediate sheet had a thickness of 0.55 mm, a basis weight of 310 g/m$^2$, and an apparent density of 0.56 g/cm$^3$.

Then, as an emulsion of a second elastic polymer, an emulsion of a second polyurethane containing 1 mass % of a self-emulsified amorphous polycarbonate urethane with a 100% modulus of 3.0 MPa was prepared. Then, the second intermediate sheet was impregnated with the emulsion of the second polyurethane, and thereafter dried at 130° C., to solidify the second polyurethane. In this manner, a napped artificial leather gray fabric was formed. Then, the napped artificial leather was subjected to a flexibilizing treatment by being treated using a jet dyeing machine at a temperature of 120° C. for 10 minutes, and then impregnated with an aqueous dispersion of an amino-modified silicone at a solid content of 0.4%, and dried at 130° C., thus obtaining a napped artificial leather. The second polyurethane content contained in the napped artificial leather was 0.5 mass %, and the total ratio of the first polyurethane and the second polyurethane was 10 mass %.

In this manner, a dark-black napped artificial leather that had a napped surface on one side thereof, included a non-woven fabric of polyester fibers containing 5 mass % of carbon black and having an average fineness of 0.2 dtex, and had a thickness of 0.6 mm, a basis weight of 310 g/m$^2$, and an apparent density 0.52 g/cm$^3$ was obtained.

Then, the lightness, the peel strength, the color migration resistances to a multifiber adjacent fabric during pressurization under heating in a wet state and a dry state, the color migration resistance to a vinyl chloride film, and the color fastness to ultraviolet carbon arc lamp light of the obtained napped artificial leather were evaluated as follows.

(Lightness L*)

Using a spectrophotometer (CM-3700 manufactured by Minolta), the lightness L* value was determined in accordance with JIS Z 8729 from the coordinate values of the L*a* b* color system on the surface of the napped artificial leather. The value was an average of the values for three points evenly selected from average positions of the test piece.

(Peel Strength)

Two test pieces each having a length of 15 cm and a width of 2.5 cm were cut out from the napped artificial leather. Then, a superposed body in which the two test pieces were superposed with a 100-μm polyurethane film (NASA-600, 10 cm in length and 2.5 cm in width) interposed therebetween was obtained. Note that the polyurethane film was not placed on portions of 2.5 cm at both ends of each of the test pieces. Then, using a plate hot pressing machine, the superposed body was bonded by being pressed for 60 seconds at a temperature of 130° C. under a surface pressure of 5 kg/cm$^2$, to form an evaluation sample. The unbonded 2.5 cm portions of the obtained evaluation sample were respectively held by the upper and lower chucks by using a tensile teste at room temperature, and an s-s curve was measured at a tensile speed of 10 cm/min. Taking a median value of the portion where the s-s curve was substantially constant as an average value, a value obtained by dividing the average value by the sample width 2.5 cm was used as a peel strength. The value was an average value of the three test pieces.

(Color Migration Resistances to Multifiber Adjacent Fabric During Pressurization Under Heating in Wet State and Dry State)

A multifiber adjacent fabric (co-woven fabric No. 1) prescribed in JIS L 0803 Annex JA and in which woven fabrics of cotton, nylon, acetate, wool, rayon, acrylic, silk, and polyester were woven so as to be parallel to each other was prepared. Also, a test piece of 10 cm×4 cm was cut out from the napped artificial leather. Then, in accordance with Method A-3 of JIS L 0850 Test Method for Color Fastness to Hot Pressing, the multifiber adjacent fabric that had been wetted or dried was placed on a test stand, then the test piece that had been wetted or dried was placed thereon, and the multifiber adjacent fabric that had been wetted or dried was further placed thereon. Then, in a state in which a pressure of 4 kPa was applied to the test piece, the whole was left for 60 seconds in a dry-heat dryer set at 200+1° C., and then taken out. The grade was determined using a Grey scale for assessing staining for each of the woven fabrics, and the grade of the woven fabric made of the most contaminated material was used as the grade of the color migration resistance.

(Color Migration Resistance to Vinyl Chloride film)

A test piece of 3 cm×2 cm was cut out from the napped artificial leather. Then, a vinyl chloride film (white) with a thickness of 0.8 mm was placed on the napped surface of the cut-out napped artificial leather, and pressure was uniformly applied thereto such that the load was 750 g/cm$^2$. Then, the whole was left for 16 hours under an atmosphere of 50° C. and a relative humidity of 15%. Then, the color difference ΔE between the vinyl chloride film before color migration and the vinyl chloride film after color migration was measured using a spectrophotometer, and the measured value was evaluated according to the following criteria:

Grade 5: $0.0 \leq \Delta E^* \leq 0.2$

Grade 4-5: $0.2 < \Delta E^* \leq 1.4$

Grade 4: $1.4 < \Delta E^* \leq 2.0$

Grade 3-4: $2.0 < \Delta E^* \leq 3.0$

Grade 3: $3.0 < \Delta E^* \leq 3.8$

Grade 2-3: $3.8 < \Delta E^* \leq 5.8$

Grade 2: $5.8 < \Delta E^* \leq 7.8$

Grade 1-2: $7.8 < \Delta E^* \leq 11.4$

Grade 1: $11.4 < \Delta E^*$ (Lightfastness to Ultraviolet Carbon Arc Lamp Light)

Based on JIS L 0842, the napped surface of the napped artificial leather was subjected to irradiation using an ultraviolet fade meter (U48 manufactured by Suga Test Instruments Co., Ltd.). The test piece was taken out every 20 hours, and comparisons were made with a Grey scale for assessing change in colour. The JIS grade was determined from the time elapsed until a color difference of grade 4 had occurred, taking 100 hours as the maximum.

(Quality <Two-Color Impression and Tactile Impression>)

A test piece of 20 cm×20 cm was cut out from the napped artificial leather. Then, the appearance of the napped surface of the test piece as observed visually and the tactile impression of the napped surface were evaluated according to the following criteria:

A: The napped surface did not show a two-color impression of the fibers and the elastic polymer when observed visually, and a smooth tactile impression.

B: The napped surface showed a two-color impression due to a difference between the color of the fibers and the color of the elastic polymer when observed visually, and was inferior in elegance.

C: The napped surface had a rough tactile impression, and was inferior in surface touch.

D: The napped surface had a pale color, and was inferior in the elegance of the appearance.

The results are shown in Table 1 below.

obtained napped artificial leather was evaluated in the same manner as in Example 1. The results are shown in Table 1.

Example 3

A napped artificial leather was obtained in the same manner as in Example 1 except that the number of islands of the island component resin was 5, the average fineness was 0.5 dtex, and the content ratio of the carbon black contained in the island component resin was 1 mass %. Then, the obtained napped artificial leather was evaluated in the same manner as in Example 1. The results are shown in Table 1.

TABLE 1

| Example No. | | 1 | 2 | 3 | 4 | 5 | 6 | 7 | Com. Ex. 1 | Com. Ex. 2 | Com. Ex. 3 | Com. Ex. 4 | Com. Ex. 5 |
|---|---|---|---|---|---|---|---|---|---|---|---|---|---|
| Fibers (F) | Fineness (dtex) | 0.2 | 0.08 | 0.5 | 0.2 | 0.2 | 0.2 | 0.2 | 0.08 | 0.05 | 0.05 | 1.1 | 0.2 |
| | CB ratio (mass %) | 5 | 8 | 1 | 5 | 5 | 5 | 5 | 5 | 5 | 11 | 2 | 0.4 |
| First elastic polymer (P1) | CB ratio (mass %) | — | — | — | — | — | — | — | 5 | — | — | — | — |
| Second elastic polymer (P2) | Pigment | — | — | — | — | — | Present | Present | — | — | — | — | — |
| | Mass % | | | | | | 20 | 20 | — | — | — | — | — |
| Ratio of F/P1/P2 | Mass % | 90/9.5/0.5 | 90/9.5/0.5 | 90/9.5/0.5 | 86/13.5/0.5 | 86/13.5/0.5 | 88/9.3/2.7 | 97.5/0/2.5 | 70/30/0 | 90/9.5/0.3 | 90/9.5/0.5 | 90/9.5/0.5 | 90/9.5/0.5 |
| Dyeing | | — | — | — | Metal complexed dye 5% owf | Sulfur dye 5% owf | — | — | — | — | — | — | Disperse dye 15% owf |
| Lightness | L* value | 16.6 | 17.2 | 18.5 | 16.3 | 16 | 16 | 15.4 | 17.8 | 21.6 | 18.8 | 16 | 17.6 |
| Peel strength | kg/cm2 | 3.8 | 3.1 | 4.4 | 3.9 | 3.6 | 3.8 | 3.3 | 2.7 | 3.3 | 2 | 4.4 | 3.5 |
| Color migration resistance during pressurization under heating (wet) | Grade | 4-5 | 4-5 | 4-5 | 4-5 | 4-5 | 4-5 | 4-5 | 3 | 4-5 | 4-5 | 4-5 | 2 |
| Color migration resistance during pressurization under heating (dry) | Grade | 4-5 | 4-5 | 4-5 | 4-5 | 4-5 | 4-5 | 4-5 | 3-4 | 4-5 | 4-5 | 4-5 | 2-3 |
| Color fastness to ultraviolet carbon arc lamp light | Grade | >6 | >6 | >6 | >6 | 5 | >6 | >6 | 5 | >6 | >6 | >6 | 2-3 |
| Color migration resistance to vinyl chloride film | Grade | 5 | 5 | 3 | 4-5 | 5 | 5 | 5 | 4 | 5 | 5 | 5 | 2 |
| Quality <zwo-color impression and tactile impression> | A-D | A | A | A | A | A | A | A | B-C | D | A | C | A |

*CB: carbon black

Example 2

A napped artificial leather was obtained in the same manner as in Example 1 except that the number of islands of the island component resin was 50, the average fineness was 0.08 dtex, and the content ratio of the carbon black contained in the island component resin was 8 mass %. Then, the

Example 4

A napped artificial leather was obtained in the same manner as in Example 1 except that the polyurethane concentration of the emulsion of the first polyurethane was changed from 15 mass % to 21 mass %, and that, after perfo ming a flexibilizing treatment using a jet dyeing machine at a temperature of 120° C. for 10 minutes, a metal complexed dye dyeing treatment was performed at 90° C. in a dyeing bath of 5%owf of a metal complexed dye (black/blue mass ratio: 50/50 mass %), and drying was performed at 120° C. Then, the obtained napped artificial leather was evaluated in the same manner as in Example 1. Note that Example 4 was adjusted so as to be bluish by being dyed with the metal complexed dye. The results are shown in Table 1.

Example 5

A napped artificial leather was obtained in the same manner as in Example 1 except that the polyurethane concentration of the emulsion of the first polyurethane was changed from 15 mass % to 21%, and that, after performing a flexibilizing treatment using a jet dyeing machine at a temperature of 120° C. for 10 minutes, dip-nipping was performed in a dyeing bath of 5%owf of a sulfur dye (black/blue mass ratio: 50/50 mass %), and drying was performed at 120° C. Then, the obtained napped artificial leather was evaluated in the same manner as in Example 1. Note that Example 5 was adjusted so as to be bluish by being dyed with the sulfur dye. The results are shown in Table 1.

Example 6

A napped artificial leather was obtained in the same manner as in Example 1 except that the polyurethane concentration of the emulsion of the second polyurethane was changed from 1 mass % to 5 mass %, and that an emulsion in which a water-dispersed carbon black pigment and a water-dispersed blue pigment (mass ratio: 50/50 mass %) were mixed to the emulsion of the second polyurethane at a solid content of 1 mass % was impregnated as the second polyurethane emulsion, and drying was performed at 130° C. Then, the obtained napped artificial leather was evaluated in the same manner as in Example 1. Note that Example 6 was adjusted so as to be bluish by being dyed with the water-dispersed blue pigment. The results are shown in Table 1.

Example 7

A napped artificial leather was obtained in the same manner as in Example 6 except that the treatment of impregnating the emulsion of the first polyurethane was not performed. Then, the obtained napped artificial leather was evaluated in the same manner as in Example 1. The results are shown in Table 1.

Comparative Example 1

A napped artificial leather was obtained in the same manner as in Example 1 except that the number of islands of the island component resin was 50, the average fineness was 0.08 dtex, and the content ratio of the carbon black contained in the island component resin was 5 mass %, the area shrinkage before and after the heat-moisture shrinking treatment was 25%, the polyurethane concentration of the emulsion of the first polyurethane was changed from 15 mass % to 30 mass %, and an emulsion in which 5 mass % of carbon black relative to the first polyurethane was blended was used as the emulsion of the first polyurethane. Then, the obtained napped artificial leather was evaluated in the same manner as in Example 1. The results are shown in Table 1.

Comparative Example 2

A napped artificial leather was obtained in the same manner as in Example 1 except that the number of islands of the island component resin was 90, and the average fineness was 0.05 dtex. Then, the obtained napped artificial leather was evaluated in the same manner as in Example 1. The results are shown in Table 1.

Comparative Example 3

A napped artificial leather was obtained in the same manner as in Example 1 except that the number of islands of the island component resin was 90, the average fineness was 0.05 dtex, and the content ratio of the carbon black contained in the island component resin was 11 mass %. Then, the obtained napped artificial leather was evaluated in the same manner as in Example 1. The results are shown in Table 2.

Comparative Example 4

A napped artificial leather was obtained in the same manner as in Example 1 except that the number of islands of the island component resin was 2, the average fineness was 1.1 dtex, and the content ratio of the carbon black contained in the island component resin was 2 mass %. Then, the obtained napped artificial leather was evaluated in the same manner as in Example 1. The results are shown in Table 1.

Comparative Example 5

A napped artificial leather was obtained in the same manner as in Example 1 except that the content ratio of the carbon black contained in the island component resin was 0.4 mass %, that a disperse dye dyeing treatment was performed by adding 15%owf of a disperse dye using a jet dyeing machine at a temperature 120° C. for 60 minutes, that an alkali washing treatment, water washing, and a drying treatment were performed at 70° C. for 20 minutes. Then, the obtained napped artificial leather was evaluated in the same manner as in Example 1. The results are shown in Table 1.

Referring to Table 1, all of the napped artificial leathers of Examples 1 to 7 had a peel strength of 3 kg/cm or more, had good dark color development with a lightness L* value of ≤20, had a grade 4 or more of the color migration resistance to a multifiber adjacent fabric during pressurization under heating in a wet state and a dry state under both wet and dry conditions, and had a vinyl chloride film color migration of $\Delta E^* \leq 2.0$, so that they were also excellent in the elegance of the appearance. On the other hand, the napped artificial leather of Comparative Example 1 was not impregnated with the second elastic polymer, and thus had a low peel strength, was inferior also in the color migration resistance to a multifiber adjacent fabric, also had an appearance showing a conspicuous two-color impression due to the high content ratio of the elastic polymer, and had a rough surface touch. The napped artificial leather of Comparative Example 2 did not develop a deep dark color because its average fineness was too low. The napped artificial leather of Comparative Example 3 suffered a reduction in fiber strength because the ratio of the carbon black contained in the fibers was too high, and thus had a low peel strength. The napped artificial leather of Comparative Example 4 exhibited an excellent dark color development due to its high average fineness, but had a rough surface and thus was of low quality. The napped artificial leather of the Comparative Example 5, which was dyed with a disperse dye, was inferior in light resistance and color migration resistance.

INDUSTRIAL APPLICABILITY

The napped artificial leather obtained according to the present invention can be preferably used as a skin material for clothing, bags, shoes, articles of furniture, car seats, general merchandise, and the like. In particular, even when being processed under heating or being brought into contact with various materials or various colors, the napped artificial leather is less likely to cause color migration, and also has an excellent light resistance.

The invention claimed is:

1. A napped artificial leather comprising:

a non-woven fabric that is an entangled body of a fiber bundle of polyester fibers having an average fineness of from 0.07 to 0.5 dtex; and an elastic polymer applied in the non-woven fabric, wherein the polyester fibers comprise from more than 5 mass % to 10 mass % of a dark color pigment, a content ratio of the elastic polymer is from 0.1 to 14 mass % in the napped artificial leather, the elastic polymer comprises a first elastic polymer that is present outside the fiber bundle, and a second elastic polymer that is present inside the fiber bundle, the napped artificial leather is not dyed, or is dyed with a metal complexed dye or a sulfur dye, the napped artificial leather has a napped surface on which the polyester fibers on at least one side thereof are napped, and the napped surface has a lightness L* value based on the L*a*b* color system, of ≤20, and the napped artificial leather has a peel strength of 3 kg/cm or more, and a grade of color difference, determined using a Grey scale for assessing staining in an evaluation of color migration to a multifiber adjacent fabric (co-woven fabric No. 1) during pressurization under heating in a wet state under a load of 4 kPa at 200° C. for 60 seconds, of 4 or more.

2. The napped artificial leather according to claim 1, wherein a content ratio of the second elastic polymer is from 0.1 to 3 mass % in the napped artificial leather.

3. The napped artificial leather according to claim 1, wherein the napped artificial leather is not dyed.

4. The napped artificial leather according to claim 1, wherein the napped artificial leather is dyed with the metal complexed dye or the sulfur dye.

5. The napped artificial leather according to claim 1, wherein the elastic polymer is free of a dark color pigment.

6. The napped artificial leather according to claim 1, wherein the polyester fibers are isophthalic acid-modified polyester fibers.

7. The napped artificial leather according to claim 1, wherein the napped artificial leather has a grade of color difference, determined using a Grey scale for assessing staining in an evaluation of color migration to a multifiber adjacent fabric (co-woven fabric No. 1) during pressurization under heating in a dry state under a load of 4 kPa at 200° C. for 60 seconds, of 4 or more.

8. The napped artificial leather according to claim 1, wherein the napped artificial leather has a grade of color difference, determined using a Grey scale for assessing change in color in a test of lightfastness to ultraviolet carbon arc lamp light in accordance with JIS L 0842, of 4 or more.

9. The napped artificial leather according to claim 1, wherein the napped artificial leather has a property of showing a color difference of a vinyl chloride film before and after color migration, determined in an evaluation of color migration to the vinyl chloride film under a load of 750 g/cm$^2$ at 50° C. for 16 hours, of $\Delta E^* \leq 2.0$.

10. The napped artificial leather according to claim 5, wherein the dark color pigment comprises carbon black.

11. The napped artificial leather according to claim 1, wherein the napped surface has the lightness L* value based on the L*a*b* color system, of ≤18.

* * * * *